US006980110B1

(12) United States Patent
Hoben et al.

(10) Patent No.: US 6,980,110 B1
(45) Date of Patent: Dec. 27, 2005

(54) APPARATUS FOR REMOTE NOTIFICATION

(75) Inventors: John Charles Hoben, Sugarland, TX (US); Allen Westmoreland, Sugarland, TX (US); Larry Fly, Dripping Springs, TX (US)

(73) Assignee: Gauging Systems Inc., Sugar Land, TX (US)

( * ) Notice: Subject to any disclaimer, the term of this patent is extended or adjusted under 35 U.S.C. 154(b) by 96 days.

(21) Appl. No.: 10/678,574

(22) Filed: Oct. 3, 2003

Related U.S. Application Data

(60) Provisional application No. 60/416,012, filed on Oct. 4, 2002.

(51) Int. Cl.[7] ..... G08B 13/14

(52) U.S. Cl. ..... 340/569; 340/533; 340/539.1; 340/539.22; 340/540; 340/545.6; 340/666

(58) Field of Search ..... 340/545.6, 568.1, 340/569, 572.1, 666, 540, 522, 531, 533, 340/539.1, 539.13, 539.22, 539.26, 539.32

(56) References Cited

U.S. PATENT DOCUMENTS 5,818,336 A * 10/1998 Varga et al. ..... 340/539.1
5,861,805 A * 1/1999 Reeves ..... 340/568.1
5,963,134 A * 10/1999 Bowers et al. ..... 340/572.1
6,028,517 A * 2/2000 Sansone et al. ..... 340/569
6,483,433 B2 * 11/2002 Moskowitz et al. ..... 340/568.1
6,784,796 B2 * 8/2004 Johnston et al. ..... 340/568.1
6,816,074 B2 * 11/2004 Wong ..... 340/569
2003/0222760 A1 * 12/2003 Hara ..... 340/5.73

* cited by examiner

*Primary Examiner*—Thomas Mullen
(74) *Attorney, Agent, or Firm*—Buskop Law Group, P.C; Wendy Buskop

(57) ABSTRACT

The apparatus for providing notices to a user interface concerning status of at least one item in a container involves a loading opening and a collection opening, a first sensor connected to the loading opening for generating a first signal when an item is inserted in the container, a second sensor connected to the collection opening for generating a second signal when the item is removed from the container, an intelligent device connected to the first and second sensors for receiving the signals and generating intelligent device signals, a communication system in contact with the intelligent device for receiving the intelligent device signals, a software interface in contact with the communication system that processes the intelligent device signals, and a user interface in contact with the software interface that receives the intelligent device signals processed from the software interface.

18 Claims, 2 Drawing Sheets

APPARATUS FOR REMOTE NOTIFICATION

This application claims benefit of 60/416,012 filed Oct. 4, 2002.

FIELD OF THE INVENTION

The present embodiment relates to an apparatus for identifying items present or not present in a container to a user interface.

BACKGROUND OF THE INVENTION

The present apparatus relates to a remote notification system concerning the status of containers in remote locations. More particularly, to the automatic notification, to a remote station or operator in response to whether a container has a package and whether that package has been removed.

It is important in the tracking of numerous remote containers, such as common carrier drop boxes, group mail collection sites, federal post office boxes, and private postal boxes, to know when packages have been delivered and picked up. The ability to know whether a given container is full or empty would reduce the time it takes to check each box individually, especially boxes that are empty.

Cutting down on the number of trips necessary to these remote container locations would reduce wear on vehicles, reduce gasoline wasted on the delivery/pick-up trucks, and increase the overall pick-up efficiency, especially operator time spent in checking and re-checking empty container boxes. Further, a fewer number of delivery trips to the containers would reduce the danger to the drivers and others that occur on the roads.

In addition, since the status of whether a container has a package or not is known and the extra trips to check boxes are reduced, companies can afford to install more boxes at more locations, thereby increasing coverage to better serve the consumers. The notification also allows user to be alerted when vandalism has occurred to the containers and allow the user to quickly notify the police.

The object of the present apparatus, therefore, is to provide a new and improved technique for notification to a user of the status of remote containers as to whether the container has a package or not.

Other advantages of the present apparatus will become apparent as the following description proceeds, and the features characterizing the apparatus will be pointed out with particularity in the claims annexed to and forming a part of this specification.

SUMMARY OF THE INVENTION

The apparatus for providing notices to a user interface concerning status of at least one item in a container has a container with an opening and two sensors to generate signals, one for when an item is inserted in the container and one for when the item is removed from the container. The apparatus also has an intelligent device connected to the sensors for receiving the signals and generating intelligent device signals. The intelligent device signals are sent to a communication system. The communication system is radio, cellular, fiber optic, satellite, and wires. The apparatus also entails a software interface in contact with the communication system that processes the intelligent device signals. Finally, the apparatus has a user interface in contact with the software interface that receives the intelligent device signals processed from the software interface.

The apparatus is also used as a security system for providing security notice to a user interface concerning a container.

BRIEF DESCRIPTION OF THE DRAWINGS

The present method will be explained in greater detail with reference to the appended Figures, in which.

The present apparatus is detailed below with reference to the listed Figures.

DETAILED DESCRIPTION OF THE PREFERRED EMBODIMENTS

Before explaining the present apparatus in detail, it is to be understood that the apparatus is not limited to the particular embodiments and that it can be practiced or carried out in various ways.

An embodiment of the application is an apparatus for providing notices to a user interface concerning status of at least one item (10) in a container (14). The apparatus is shown in detail in FIG. 1 and FIG. 2.

Figure 1:
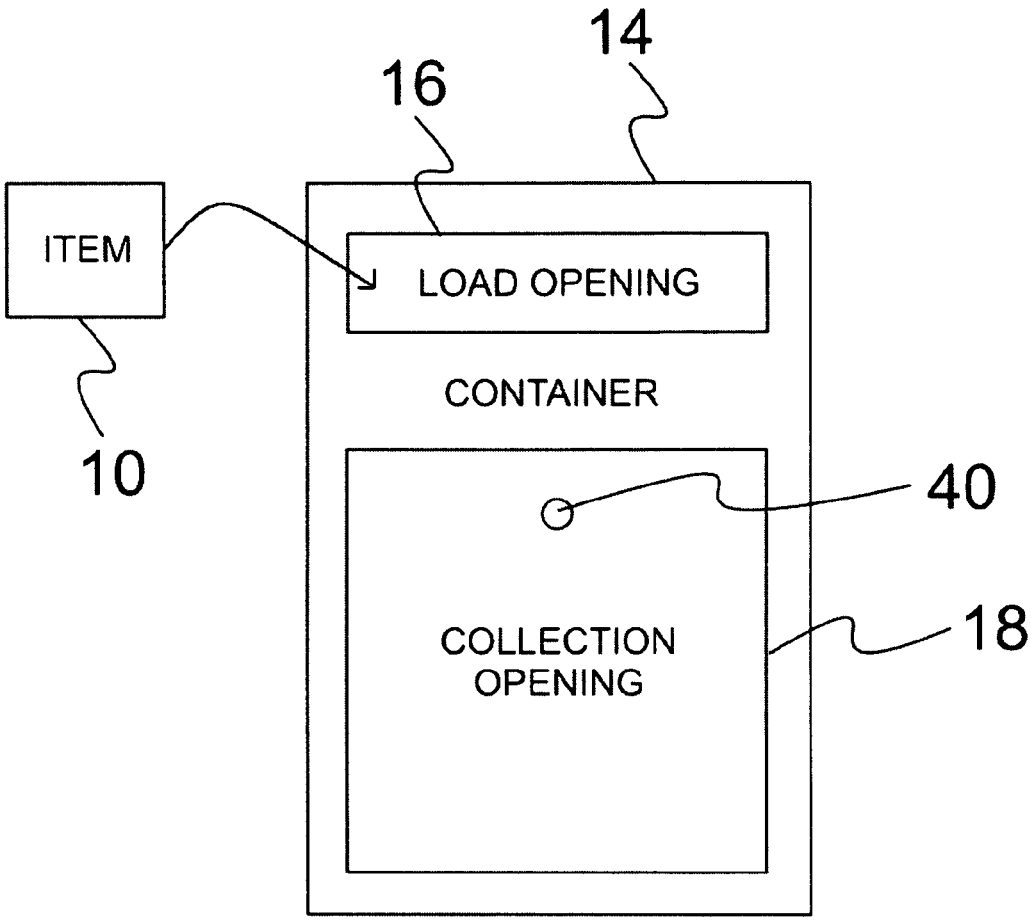
FIG. 1 depicts a view of the container.

The apparatus includes a container (14), as shown in FIG. 1, having a loading opening (16) and a collection opening (18). A first sensor (20) is connected to the loading opening (16) that generates a first signal. The first sensor can be an electromechanical switch, a magnetic switch, optical switch, an infrared switch, pressure sensor, strain gauge, analytical sensor an ultrasonic switch, or the like. The apparatus further includes an intelligent device (24), such as a remote terminal unit (RTU), connected to the first sensor (20) for receiving the first signal (22), that generates from the first sensor. The intelligent device (24) generates a first intelligent device signal (26). The intelligent device (24) is in contact with a communication system (28). The communication system (28) is radio, cellular, fiber optic, satellite, or wires.

The apparatus also has a second sensor (32) connected to the collection opening (18), which can be a door, for generating a second signal (34) to the intelligent device (24), wherein the intelligent device (24) is adapted to generate a second intelligent device signal (36) and communicate the second intelligent device signal to a network. The apparatus has a user interface (50) for receiving at least one signal from the communication system. Finally, the apparatus has a software interface (12) for receiving at least one signal from the communication system.

In another preferred embodiment, the loading opening (16) and the collection opening (18) are one opening.

In another preferred embodiment, the intelligent device (24) further has a counter (70) to provide information on sensor activity on a timed basis to the user interface.

In other preferred embodiments, the apparatus also has an antenna (27) for communicating the intelligent device signals to the communication system (28) and the apparatus can also have software adapted to buffer the intelligent device signals from the first sensor prior to communicating the sensor signals.

The second sensor in the apparatus can be a manually operated sensor. The sensor is an electromechanical switch, a magnetic switch, optical switch, an infrared switch, pressure sensor, strain gauge, analytical sensor, an ultrasonic switch, or the like.

The container (14) in the apparatus can further comprise a lock (40), as seen in FIG. 1, forming a locked container.

The container (14) is a common carrier drop box, a group mail collection site, a federal post office box, private postal box, or the like.

The intelligent device (24) in the apparatus is a digital remote terminal unit, discrete remote terminal unit, analog remote terminal unit, combinations thereof, or the like.

The communication system (28) in the apparatus is the Internet, intranet, LAN, peer- to-peer network, or the like.

The apparatus's software interface can communicate with a file transfer protocol, an internet home page, email, pager, telephone, voice activated auto-dialer, or the like.

Figure 2:
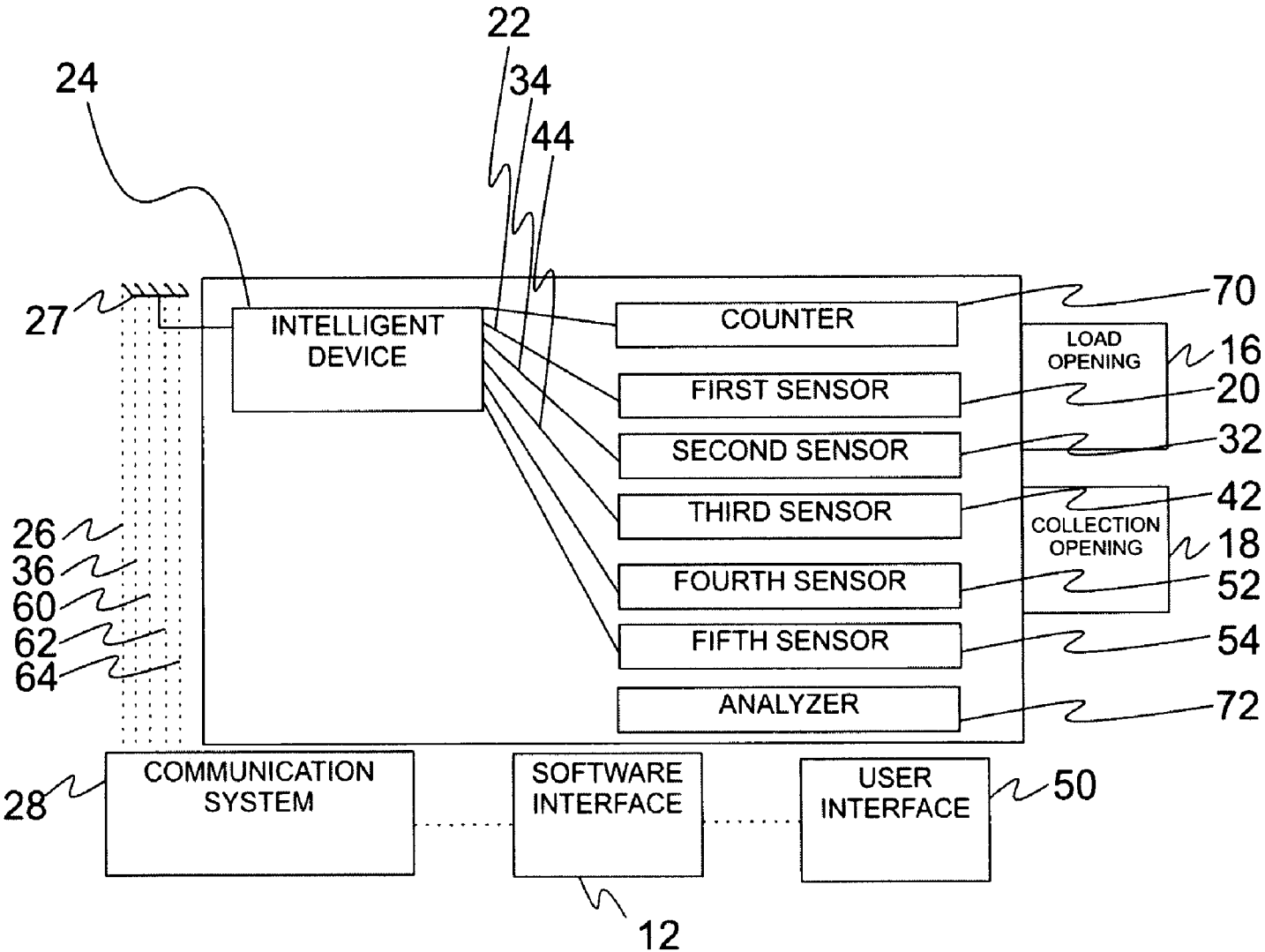
FIG. 2 is a schematic of the apparatus.

As seen in FIG. 2, in another embodiment, the apparatus has a third sensor (42) to ascertain the weight of the item in the container in communication with the intelligent device (24) providing a weight notification (60) from the communication system to the user.

Another embodiment entails the apparatus having an analyzer (72) to monitor and evaluate sensor activity.

The apparatus can also involve a fourth sensor (52) to ascertain whether the container has been tampered with. The fourth sensor (52) is in communication with the intelligent device (24) to provide a tamper notification (62) from the communication system (28) to the user. The fourth sensor (52) is shown in FIG. 2.

The apparatus can also involve a fifth sensor (54) for detecting hazardous materials. The fifth sensor (54) is in communication with the intelligent device (24) providing a hazardous material notification (64) from the communication system (28) to the user. The fifth sensor (54) is shown in FIG. 2.

In another embodiment, the apparatus includes a counter to store sensor activity and report to the user interface on a timed basis.

The apparatus is also used as a security system for providing security notice to a user interface concerning a container. The security system is shown in FIG. 1. In the most preferred embodiment, the security system includes a container (14) having a loading opening (16) and a collection opening (18), a first sensor (20) connected to the loading door for generating a signal (22), and an intelligent device (24) connected to the first sensor for receiving the signal (22) and generating an intelligent device signal (26). The system also has a communication system (28) in communication with the intelligent device (24), for receiving the intelligent device signal. The communication system is radio, cellular, fiber optic, satellite, or wires. Finally, the system includes a second sensor (32) connected to the collection door for generating a second signal (34) to the intelligent device, wherein the intelligent device is adapted to generate a second intelligent device signal and communicate the second intelligent device signal to communication system and a user interface (50) for receiving at least one signal from the network.

In another embodiment, the security system further includes a counter to provide information on sensor activity on a timed basis to the user interface.

While this apparatus has been described with emphasis on the preferred embodiments, it should be understood that within the scope of the appended claims, the invention might be practiced other than as specifically described herein.

What is claimed is:

1. An apparatus for providing notices to a user interface concerning status of at least an item in a container, comprising:

a. a container having a loading opening and a collection opening;

b. a first sensor connected to the loading opening for generating a first signal when an item is inserted in the container;

c. a second sensor connected to the collection opening for generating a second signal when the item is removed from the container;

d. an intelligent device connected to the first sensor and the second sensor for receiving the first signal from the first sensor and the second signal from the second sensor, wherein the intelligent device generates a first intelligent device signal and a second intelligent device signal, respectively;

e. a communication system that transfers the first intelligent device signal and the second intelligent device signal from the intelligent device to a software interface, wherein the communication system is selected from the group: a radio system, a cellular phone, a satellite communication system, and wired communication systems Internet, intranet, LAN, and peer-to-peer network;

f. the software interface adapted to receive the first intelligent device signal and the second intelligent device signal from the communication system, wherein the software interface processes the first intelligent device signal and the second intelligent device signal from the intelligent device; and g. a user interface in communication with the software interface that receives the first intelligent device signal and the second intelligent device signal processed from the software interface.

2. The apparatus of claim 1, wherein the item in the container is a package.

3. The apparatus of claim 1, wherein the loading opening and the collection opening are one opening.

4. The apparatus of claim 1, wherein the intelligent device is a remote terminal unit (RTU).

5. The apparatus of claim 1, wherein the intelligent device further comprises a counter to provide information based upon the number of generated first signals and second signals on a timed basis to the user interface.

6. The apparatus of claim 1, further comprising an antenna for sending the first intelligent device signal and the second intelligent device signal to the software interface.

7. The apparatus of claim 1, wherein the software interface communicates to a user using a member of the group: a file transfer protocol, an internet home page, email, pager, telephone, and voice activated auto-dialer.

8. The apparatus of claim 1, wherein the second sensor is a manually operated sensor.

9. The apparatus of claim 1, wherein the container further comprises a lock forming a locked container.

10. The apparatus of claim 1, wherein the container is a member of the group: a common carrier drop box, a group mail collection site, a federal post office box, private postal box.

11. The apparatus of claim 1, wherein the first sensor and the second sensor are selected from the group: electromechanical switches, magnetic switches, optical switches, infrared switches, pressure sensors, strain gauges, and ultrasonic switches.

12. The apparatus of claim 1, wherein the intelligent device is selected from the group: digital remote terminal unit, discrete remote terminal unit, and analog remote terminal unit and combinations thereof.

13. The apparatus of claim 1, wherein the communication system is selected from the group: Internet, intranet, LAN, and peer-to-peer network.

14. The apparatus of claim 1, further comprising a third sensor used to ascertain the weight of the item disposed in the container, and wherein the third sensor is in communication with the intelligent device and the intelligent device is adapted to provide a weight notification to the user interface.

15. The apparatus of claim 1, further comprising a fourth sensor used to ascertain whether the container has been tampered with, and wherein the fourth sensor is in communication with the intelligent device and the intelligent device is adapted to provide a tampered with notification to the user interface.

16. The apparatus of claim 1, further comprising a fifth sensor used to detect hazardous materials in the container, wherein the fifth sensor is in communication with the intelligent device and the intelligent device is adapted to provide a hazardous material notification to the user interface.

17. A security system for providing security notice to a user interface concerning a container, comprising:

a. a container having a loading opening and a collection opening;

b. a first sensor connected to the loading opening for generating a first signal when an item is inserted in the container;

c. a second sensor connected to the collection opening for generating a second signal when an item is removed in the container;

d. an intelligent device connected to the first sensor and the second sensor for receiving the first signal and the second signal, wherein the intelligent device generates a first intelligent device signal and a second intelligent device signal, respectively;

e. a communication system that transfers the intelligent device signals from the intelligent device to a software interface, wherein the communication system is selected from the group: a radio system, a cellular phone, a satellite communication system, and wired communication systems Internet, intranet, LAN, and peer-to-peer network;

f. the software interface adapted to receive the first intelligent device signal and the second intelligent device signal from the communication system, wherein the software interface processes the signals from the intelligent device; and g. a user interface in communication with the software interface that receives the processed signals from the software interface.

18. The security system of claim 17, wherein the intelligent device further comprises a counter to provide information based upon the number of generated first signals and second signals on a timed basis to the user interface.

* * * * *